US005247283A

United States Patent [19]

Kobayashi et al.

[11] Patent Number: 5,247,283

[45] Date of Patent: Sep. 21, 1993

[54] METHOD FOR TESTING SMOKE SENSOR AND A SMOKE SENSOR HAVING A FUNCTION OF EXECUTING THE TEST

[75] Inventors: Kazunori Kobayashi; Takeshi Sato, both of Fukushima, Japan

[73] Assignee: Matsushita Electric Works, Ltd., Osaka, Japan

[21] Appl. No.: 669,608

[22] Filed: Mar. 14, 1991

[51] Int. Cl.[5] ..... G08B 17/10

[52] U.S. Cl. ..... 340/630; 340/628; 340/629

[58] Field of Search ..... 340/630, 628, 629

[56] References Cited

U.S. PATENT DOCUMENTS

| | | | |
|---|---|---|---|
| 4,851,819 | 7/1989 | Kawai et al. | 340/630 |
| 4,857,895 | 8/1989 | Kaprelian | 340/630 |
| 4,897,634 | 1/1990 | Sawa et al. | 340/630 |
| 4,901,056 | 2/1990 | Bellavia et al. | 340/630 |

FOREIGN PATENT DOCUMENTS

| | | | |
|---|---|---|---|
| 55-26515 | 7/1980 | Japan . | |
| 2-181297 | 7/1990 | Japan . | |
| 0230396 | 9/1990 | Japan | 340/630 |
| 0230397 | 9/1990 | Japan | 340/630 |
| 9016053 | 12/1990 | World Int. Prop. O. | 340/629 |

*Primary Examiner*—John K. Peng
*Assistant Examiner*—Edward Lefkowitz
*Attorney, Agent, or Firm*—Burns, Doane, Swecker & Mathis

[57] ABSTRACT

A method for testing smoke sensor is to set a predetermined level for alarm generation on the basis of information on a first output of a main light receiving element for a stray light caused by an emitted light from a main light emitting element, a second output of an auxiliary light receiving element for the emitted light directly received from the main light emitting element and a composite output of the first and second output whereby tests for confirming normal operation and the like of the smoke detector can be executed with high precision.

1 Claim, 4 Drawing Sheets

METHOD FOR TESTING SMOKE SENSOR AND A SMOKE SENSOR HAVING A FUNCTION OF EXECUTING THE TEST

BACKGROUND OF THE INVENTION

This invention relates to methods for testing smoke sensors as well as the smoke sensors having a function of executing the test according to such method.

Such testing function for the smoke sensors of the kind referred to may be effectively contribute to automatic tests for confirming normal operation and so on of the smoke sensors at a remote position therefrom.

DESCRIPTION OF RELATED ART

Referring to known smoke sensors, there has been suggested in, for example, Japanese Patent Publication No. 55-26515 of Yasumasa Teraoka et al., a smoke sensor which comprises a main light source, a main light receiving element disposed for not receiving directly a light beam from the main light source but receiving a scattered light of the light from the main light source, an auxiliary light source disposed for causing an auxiliary light beam to be incident directly on the main light receiving element, and an auxiliary light receiving element for receiving directly the light beam from the main light source. Upon testing this sensor, the light beam from the main light source in its normal lighting state is made incident on the auxiliary light receiving element, an output signal from this auxiliary light receiving element in response to received amount of this incident light is processed at a proper electronic signal processing circuit, the auxiliary light source is lighted by an output of the processing circuit, the light from the auxiliary light source is made incident on the main light receiving element, and an output signal of the main light receiving element in response to received amount of this light received is processed at a further proper electronic signal processing circuit so that a reporting operation can be executed as required. With this arrangement, it is made possible to discriminate from the outputs of the main and auxiliary light receiving elements whether or not a sensing space within the smoke sensor is in a normal operational state.

In the known smoke sensors of the kind referred to, on the other hand, there has been provided at an inlet port for leading smoke thereinto a net for preventing dust, insects and the like from entering into the interior, and this dust preventing net has been a cause of a trouble once the net is clogged by the dust or the like so that flow rate of smoke to the interior of the sensor may be reduced or even the smoke flow may be blocked. This problem has not been part of the testing operation of the known smoke sensor.

As an arrangement for detecting such clogging of the dust preventing net, there has been suggested in, for example, Japanese Laid-Open Patent Publication No. 2-181297 of Kazunori Kobayashi, a smoke sensor in which an auxiliary light emitting element is disposed outside the dust preventing net, a light receiving element is provided to be capable of receiving a stray light beam caused to be present through the dust preventing net and inside a sensing space, an output signal of the light receiving element in accordance with the quantity of light received is processed at a proper signal processing circuit. The clogging of the dust preventing net can be detected on the basis of an information based on the processed signal. So long as the sensor is in its normal operation, any scattered light of the light from the main light emitting element is made to be receivable at the main light receiving element while the descent in the quantity of light received at the light receiving element can be caused to occur even due to a deterioration of the main light receiving element. Consequently, the descent in the quantity of light received at the light receiving element is caused by the deterioration of the main light emitting element in addition to the clogging of the dust preventing net, so that there arises a difficulty in discriminating between these different causes.

SUMMARY OF THE INVENTION

It is a primary object of the present invention, therefore, to provide a method for testing the smoke sensor of scattering and photoelectric type which can overcome the foregoing problems and can reliably detect the deterioration of the main light emitting element and the clogging of the dust preventing net, as well as a smoke sensor having a function of executing the test.

According to the present invention, this object can be realized by a method for testing a smoke sensor in which a light beam emitted from a main light emitting element and scattered in an interior sensing space is received at a main light receiving element, and an output signal responsive to the quantity of light received at the main light receiving element is processed at a signal processing circuit for sensing the presence of smoke on the basis of an information obtained from said signal processed. The invention is characterized in that the method comprises a first step of obtaining an output of the main light receiving element corresponding to a stray light resulting from the light beam from the main light emitting element and received and electrically converted at the main light receiving element, a second step of obtaining through an electric conversion a composite output of an output of an auxiliary light receiving element corresponding to the light beam from the main light emitting element and directly received by the auxiliary light receiving element and the output corresponding to the stray light, and a third step of obtaining an emitted light level of the main light emitting element from the composite output of the second step and the output of the first step for generating an alarm when the level is other than a predetermined first level.

Other objects and advantages of the present invention shall be made clear in following description of the invention detailed with reference to embodiments shown in accompanying drawings.

Figure 1:
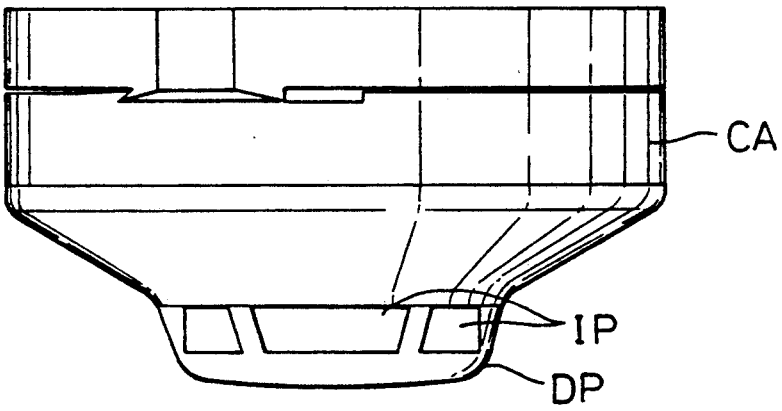
FIG. 1 is a schematic side view of the smoke sensor having the function of executing the test according to the present invention.

While the present invention shall now be explained with reference to the embodiments shown in the drawings, it should be appreciated that its intention is not to limit the present invention only to the particular embodiments but rather to include all alterations, modifications and equivalent arrangements possible within the scope of appended claims.

DETAILED DESCRIPTION OF THE PREFERRED EMBODIMENTS

Figure 2:
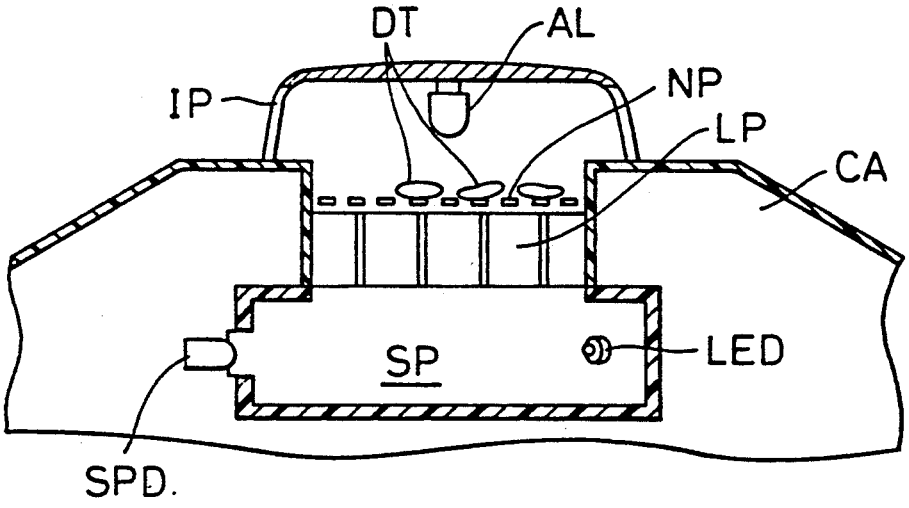
FIG. 2 is a sectioned view at a main part of the smoke sensor of FIG. 1.
Figure 3:
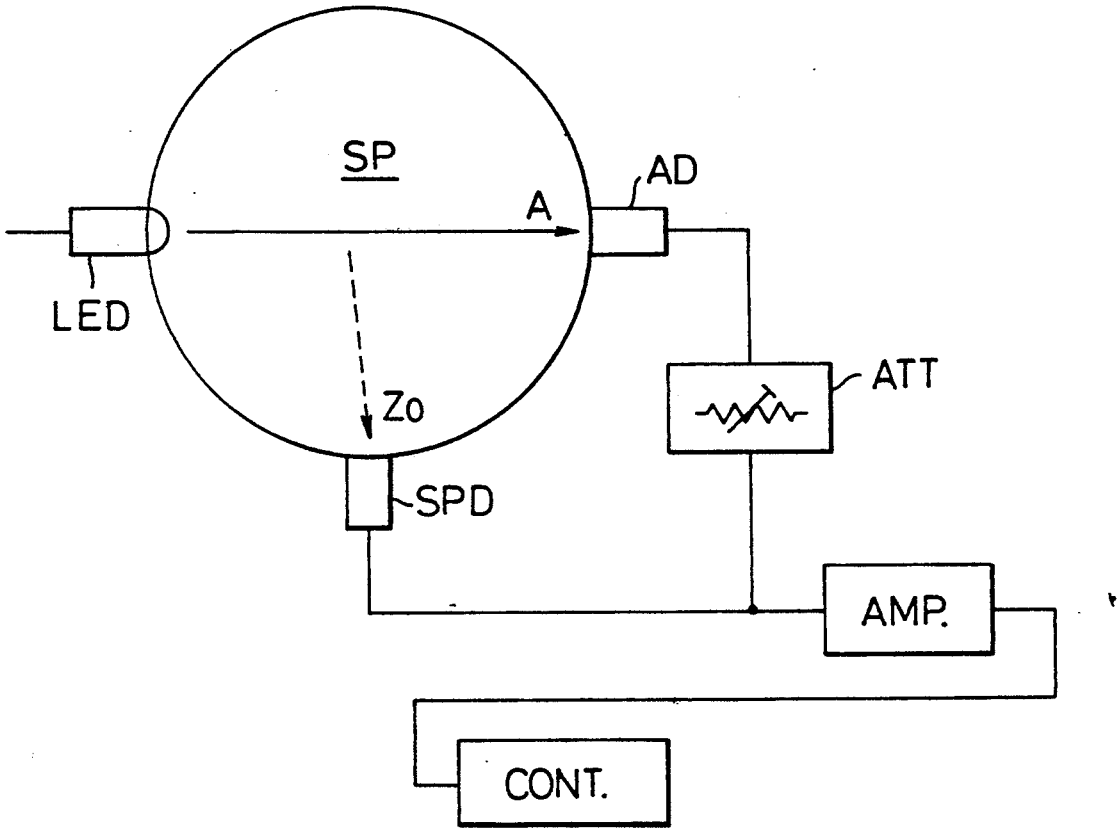
FIG. 3 is a schematic block diagram of the smoke sensor with the signal processing circuit as in FIG. 1.

First, a smoke sensor having a function of executing a test according to the present invention shall be described with reference to FIGS. 1 through 3. The sensor generally comprises a casing CA which include a detecting projection DP having smoke intrusion ports IP, and a sensing space SP defined inside the casing CA and communicating with the smoke intrusion ports IP through a dust preventing net NP disposed between the sensing space SP and the smoke intrusion ports IP for preventing such sensing obstacles as the dust, insects and so on from entering into the space. At a proper position of peripheral wall of the sensing space SP, there is provided a main light emitting element LED while a main light receiving element SPD is provided at a proper position of the wall where a light beam emitted from the main light emitting element LED is not incident directly, and an auxiliary light receiving element AD is disposed at a proper position also of the wall where the light beam from the main light emitting element LED is incident. Further, at a position outside the dust preventing net NP but inside the detecting projection DP, an auxiliary light emitting element AL is provided for emitting a light beam through the dust preventing net NP into the sensing space SP. In addition, on the side of the sensing space SP with respect to the dust preventing net NP, scattered light absorbing plates LP are disposed for preventing a scattered light due to the dust preventing net NP from reaching directly the main light receiving element SPD. In this case, the light beam emitted from the auxiliary light emitting element AL is caused to partly pass through the dust preventing net NP and directly into the sensing space SP and to be partly reflected by the dust or the like deposited on the net, and the state of clogging of this dust preventing net NP should preferably be discriminated by sensing the former part of the light passed through the net. However, since the dusts are generally not fully obstacle to light in microscopic sense and are mostly fibrous members of milky white or light gray, they are apt to cause any incident light diffused or scattered in all directions so as to be partly added onto the passing light. Here, the scattered light absorbing plates LP are extended sufficiently toward the sensing space SP so that the scattered or diffused light can be thereby absorbed so as not to allow such light to reach the interior sensing space SP.

An attenuator ATT is connected to the auxiliary light receiving element AD, while an amplifier AMP is connected to both of the attenuator ATT and main light receiving element SPD, and a control means CONT incorporating therein a signal converting section, memories, operational section and the like is connected to this amplifier AMP. These components forming an electronic signal processing circuit are all accommodated within the casing CA to be adjacent to the sensing space SP, and the main light emitting element may be kept being constantly intermittently lighted preferably with an application of pulse voltage.

Figure 4A:
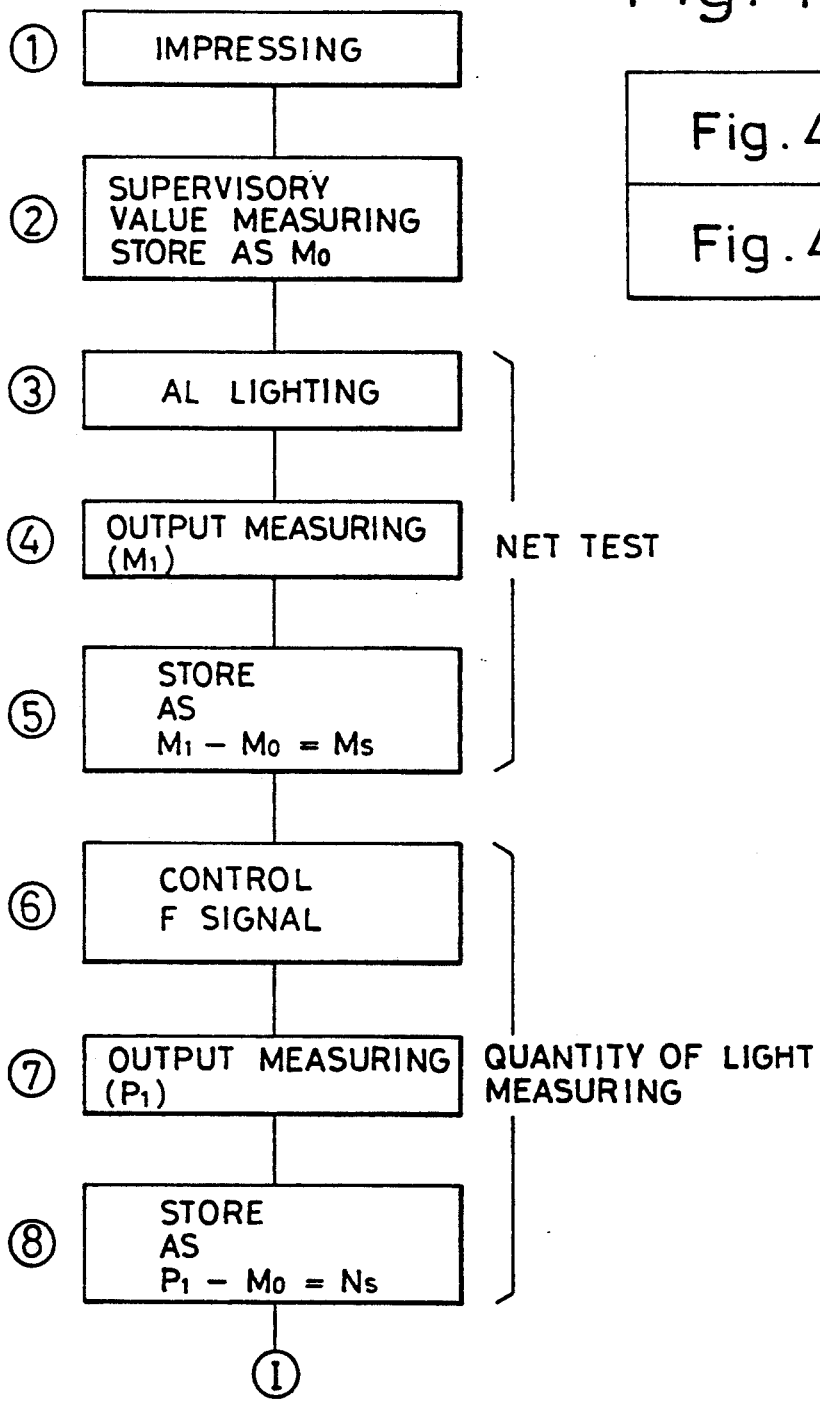
FIGS. 4A and 4B is a flow chart of the method for testing the smoke sensor of FIG. 1.
Figure 4:
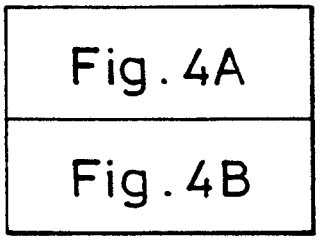
Figure 4B:
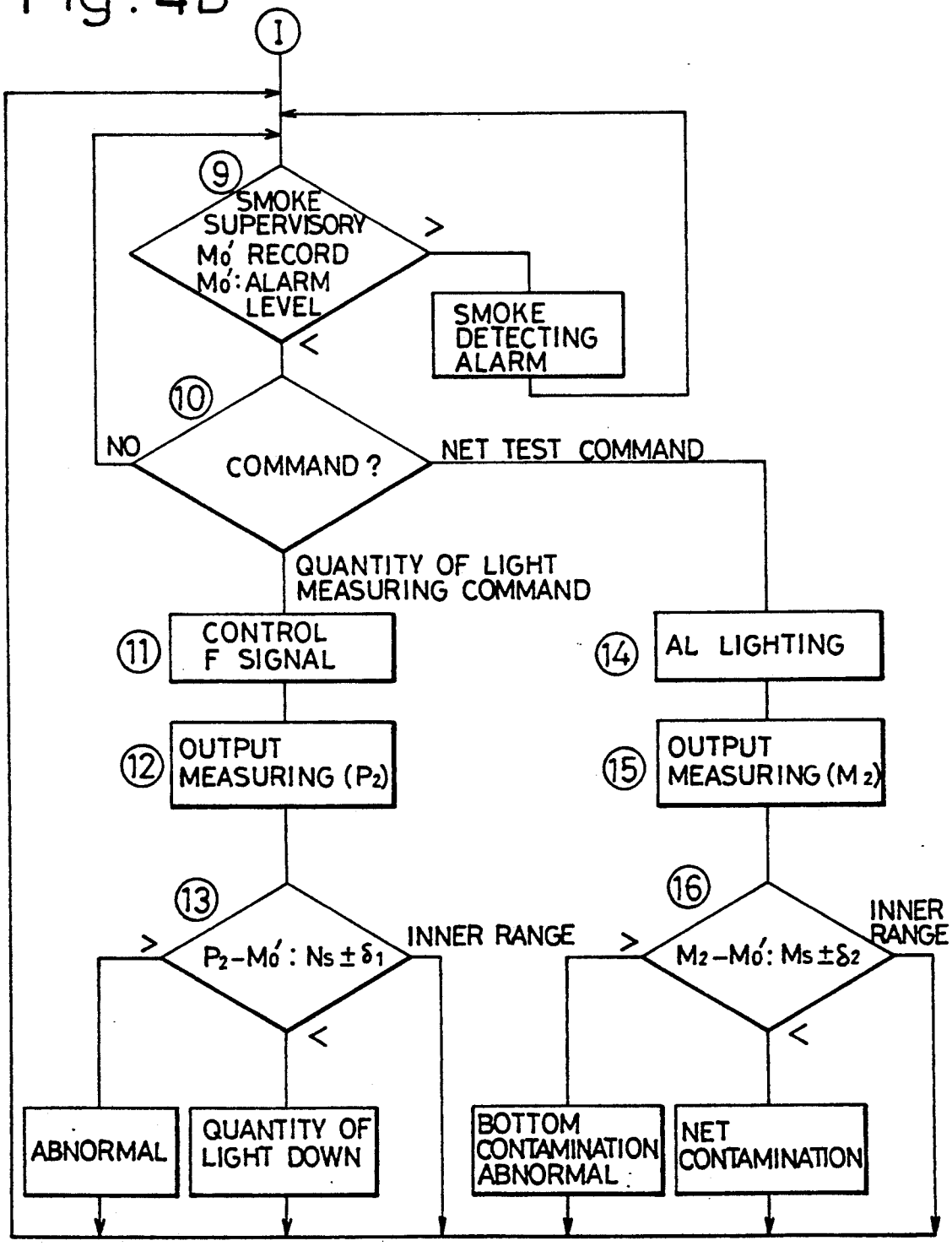

Next, the testing method of the present invention shall be explained further in conjunction with FIG. 4. In having the smoke sensor started to operate after its installation, an electric power source is connected to impress the voltage upon the sensor (step "1"), and thereafter an initial stage stray light level is measured, i.e., the main light emitting element LED is operated to have a stray light occurring on the peripheral wall of the sensing space SP upon absence of smoke received by the main light receiving element SPD (step "2"). An output of this main light receiving element SPD is amplified at the amplifier AMP and is thereafter subjected to a signal conversion for easier processing at the control means CONT, and thus converted signal is stored as the stray light level $M_0$ in a proper memory (not shown), which level $M_0$ denoting the stray light level at the initial stage of the use of the sensor where interior wall surface of the sensing space SP is not contaminated.

Figure 5:
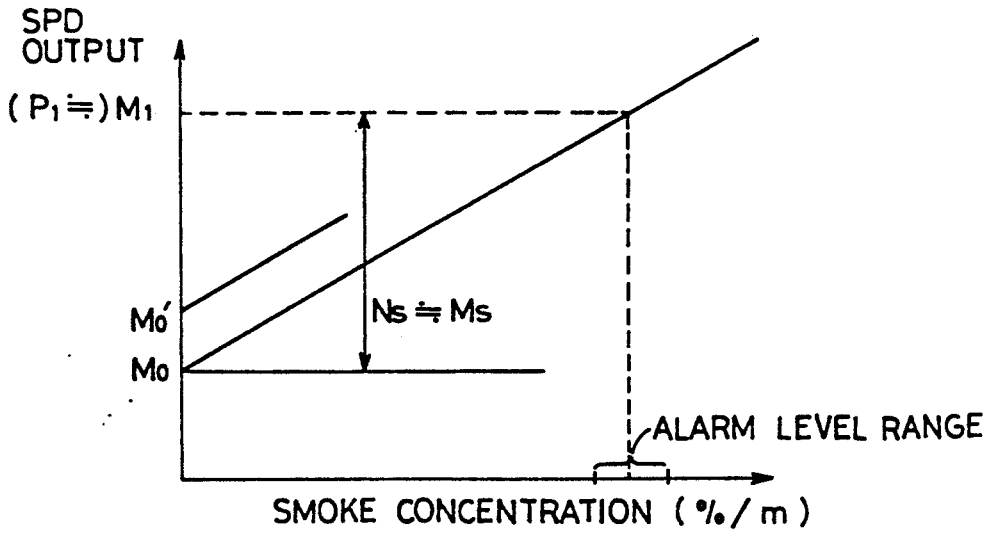
FIG. 5 shows graphically the relationship between the output of the main light receiving element and smoke concentration in the smoke sensor of FIG. 1.

Then, the auxiliary light emitting element AL is lighted with the main light emitting element LED kept in the light emitting state (step "3"), so that the stray light due to the light from the main light emitting element LED as well as a scattered light of the light beam from the auxiliary light emitting element AL and reflected on bottom wall surface of the sensing space SP will be received at the main light receiving element SPD, a resultant output of which element is amplified at the amplifier AMP and is thereafter provided to the control means CONT, and the level of this output from the main light receiving element SPD is stored as $M_1$ in the memory (step "4"). The level $M_1$ at this time is of the state of no deposition of contamination to the interior surface of the sensing space SP nor to the dust preventing net NP. For the scattered light of the light beam from the auxiliary light emitting element AL, an initial quantity of light is regulated at the stage of manufacturing the sensor so as to be of a value closer to a smoke sensing level in normal supervisory state of the main light receiving element, that is, to an alarming level. With this regulation, it is made possible to detect at a high precision a sensitivity variation of the smoke sensor since such relationship as shown in FIG. 5 between the output of the main light receiving element and the smoke concentration is assumed as being measured. Further, from the level $M_0$ obtained at the step "2" and the level $M_1$ at the step "4", an operation of $M_1-M_0=M_s$ is carried out at an operating section of the control means CONT, and the resultant level $M_s$ is stored in the memory (step "5"). With execution of these steps "3" to "5", a quantity of light passing through the dust preventing net NP at the initial stage can be measured.

Then, the main light emitting element LED is placed in the light emitting state, and the attenuator ATT is made active with a control signal applied thereto (step "6"). Thereafter, the output of the main light receiving element SPD and the output of the auxiliary light receiving element AD through the attenuator ATT are provided to the amplifier AMP to have a composite output provided thereout to the control means CONT where the level of the composite level is obtained as $P_1$ (step "7"). At the operating section of the control means CONT, the level $P_1$ obtained at the step "7" and the level $M_0$ at the step "2" are subjected to an operation of $P_1-M_0=N_s$, the result of which is stored in the memory (step "8"), wherein $N_s$ denotes a light emitting level of the light beam from the main light emitting element LED as received at the auxiliary light receiving element AD and attenuated at the attenuator ATT. Here, an adjustment is made to the attenuator ATT so that $P_1=M_1+\epsilon$ (wherein $\epsilon$ denotes minute values including zero) and, hereafter, the amount of attenuation $\lambda$ is fixed. In the event of the absence of any deposition of dust or the like in the sensing space SP or at the dust preventing net NP or, in other words, in the case of the output $M_1$ of the main light receiving element SPD at the test of the dust preventing net NP at its initial stage of use is set substantially equal to the alarming level for smoke occurrence during the normal smoke supervision, whereby the main light receiving element output and smoke concentration can be made to be of a linear relationship with the level $M_0$ made as the basic point. With such execution of the foregoing steps "6" to "8", the quantity of light emitted by the main light emitting element LED can be measured.

The foregoing steps "1" through "8" constitute a regulation at the initial stage of the use of the smoke sensor.

In the normal operating state of the smoke sensor, the main light emitting element LED is kept being intermittently lighted preferably with the application of the pulse voltage so that the emitted light beam will be incident to the sensing space SP. Upon intrusion of the smoke into the sensing space SP in the above state, the degree of scattering of the emitted light beam is caused to be relatively elevated by constituent particles of the smoke, a relatively large quantity of light is caused to be received at the main light receiving element SPD, and an alarm is thereby caused to be generated. In the absence of any intrusion of smoke into the sensing space SP, on the other hand, the stray light is present within the sensing space SP and is received by the main light receiving element SPD to have an output $M_0'$ of the amplifier AMP provided as an input to the control means CONT, and a corresponding signal is stored in a proper memory (step "9"). This output $M_0'$ is of the stray light level as a result of the contamination of the inner wall of the sensing space SP with time lapsed, which level is taken up through a sampling for a remarkably long time in comparison with variation in the output signal due to the smoke intrusion, so that a previous value will be replaced by this level to be used as a new reference for the following test. This respect per se has been known as a socalled zero point compensation, i.e., a smoke concentration 0%/m compensation. Provided that no command exists at the next stage, the step is returned to the step "9" so that the supervisory operation with respect to the sensing space SP will be continued.

When the step "9" is repeated for a predetermined number of times, a quantity of light measuring command is transmitted from a proper receiver (not shown), whereby a control signal F is provided to the attenuator ATT to make it active (step "11"). Then, the output of the main light receiving element SPD as well as the output of the auxiliary light receiving element AD passed through the attenuator ATT are amplified at the amplifier AMP to obtain an output $P_2$ (step "12"). At the control means CONT, a difference $P_2-M_0'$ between this output $P_2$ and the output $M_0'$ obtained at the step "9" is taken and is compared with $N_s\pm\delta_1$ based on the foregoing difference $N_s$ obtained at the step "8" (step "13"). The difference $P_2-M_0'$ is to represent the quantity of light emitted from the main light emitting element LED at the particular moment. So long as $P_2-M_0'$ is within the range of $N_s\pm\delta_1$, the discrimination is so made that no irregularity exists while a state where $P_2-M_0'>N_s\pm\delta_1$ is discriminated as involving an irregularity, and a state where $P_2-M_0'<N_s-\delta_1$ is discriminated as an abnormal descent of the quantity of emitted light of the main light emitting element LED to have an alarm generated. Here, $\delta_1$ is a constant for providing a tolerance of allowing the difference lying within a predetermined range to be regarded as not irregular or abnormal in the comparative determination for the measured quantity of light.

In an event where a testing command for the dust preventing net is provided from a proper receiver, on the other hand, then the auxiliary light emitting element AL is lighted (step "14"). The stray light of the light from the main light emitting element LED as well as the scattered light of the particular light as reflected at the bottom wall of the sensing space SP are made to be received at the main light receiving element SPD, its output is amplified at the amplifier AMP and an output $M_2$ is obtained (step "15"). Further, a difference $M_2-M_0'$ between this output $M_2$ and the foregoing output $M_0'$ obtained at the step "9" is operated at the control means CONT, and this difference is compared with the foregoing difference $M_s$ obtained at the step "5" (step "16"). The operated difference $M_2-M_0'$is to represent the quantity of light which has passed through the dust preventing net NP at the particular moment. Here, so long as $M_2-M_0'$ is within the range of $M_s\pm\delta_2$, the discrimination is so made as to be no irregularity is present, while a state $M_2-M_0'>M_s+\delta_2$ is discriminated to be the presence of irregularly scattered light due to the contamination at the bottom wall of the sensing space SP, and a state $M_2-M_0'<M_s-\gamma_2$ is discriminated as being the presence of the dust or the like deposited to the net NP so as to have the quantity of light passed therethrough decreased, an alarm being thereby caused to be generated. Here, $\delta_2$ is a constant for providing a tolerance of allowing the difference lying within a predetermined range to be regarded as involving no problem in the comparative determination for the measured quantity of light.

After completing the operation of the step 13or 16, the test is returned to the step "9".

In addition, it should be readily appreciated that the receiver providing the commands for testing the deterioration of the main light emitting element at the steps "11" to "13" and for testing the clogging of the dust preventing net at the steps "14"to "16" is driven by means of a command transmitted preferably automatically from a remote positioned transmitter for either one of these tests.

In the present invention, further, a variety of design modifications may be possible. While, for example, the dust preventing net has been disclosed as disposed in the interior of the detecting projection DP, the present invention is also applicable to another arrangement in which the dust preventing net is provided at the smoke intrusion ports IP of the detecting projection DP, so long as the auxiliary light emitting element is so disposed as to emit the light beam towards the sensing space from the exterior through such dust preventing net.

What is claimed is:

1. A smoke detector comprising:

a sensing space, a main light emitting element disposed within said sensing space, a dust preventing net disposed at an entrance part of said sensing space, an auxiliary light emitting element disposed outside said dust preventing net, a main light receiving element disposed at a position where a light beam emitted from said main light emitting element is not directly incident but receives a stray light in said sensing space and resulting, even in the absence of smoke, from said light beam from said main light emitting element as well as a smoke-scattered light in the presence of smoke in said sensing space and resulting, even in the absence of smoke, from a light beam from said auxiliary light emitting element to the sensing space through the dust preventing net and reflected at an inner wall surface of the sensor, an auxiliary light receiving element provided for receiving directly said light beam from said main light emitting element, means, receiving an output of said auxiliary light receiving element, for generating an alarm indicative of a deterioration in the sensing level due to a clogging of the dust preventing net when said output of the auxiliary light receiving element is outside a predetermined range, means, connected to said auxiliary light receiving element, for attenuating said output thereof to a level close to an alarming level of an output of said main light receiving element, and means, connected to said main light receiving element and to said attenuating means as well, for amplifying said output of the main light receiving element and said output attenuated of the auxiliary light receiving element.

* * * * *